US006790282B2

(12) United States Patent
Davis et al.

(10) Patent No.: US 6,790,282 B2
(45) Date of Patent: Sep. 14, 2004

(54) LANE MAINTENANCE MACHINE WITH MECHANICAL LANE DRESSING APPLICATION CONTROLLER

(75) Inventors: Mark E. Davis, Sebring, FL (US); John M. Davis, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 0 days.

(21) Appl. No.: 10/458,462

(22) Filed: Jun. 10, 2003

(65) Prior Publication Data

US 2004/0010873 A1 Jan. 22, 2004

Related U.S. Application Data

(60) Provisional application No. 60/388,662, filed on Jun. 12, 2002.

(51) Int. Cl.[7] ..... B05C 21/00

(52) U.S. Cl. ..... 118/663; 118/681; 118/683; 118/684; 118/207; 118/244; 118/264; 15/4; 15/98; 15/319; 15/320; 15/103.5

(58) Field of Search ..... 118/663, 679, 118/680, 681, 683, 684, 207, 244, 264; 15/4, 98, 319, 320, 103.5

(56) References Cited

U.S. PATENT DOCUMENTS 3,998,122 A 12/1976 Carty et al.

5,729,855 A 3/1998 Davis

*Primary Examiner*—Laura Edwards

(74) *Attorney, Agent, or Firm*—Hovey Williams LLP

(57) ABSTRACT

A machine for automatically applying lane dressing travels up and down the lane to apply dressing according to a certain predetermined and preselected pattern. A single dispensing head travels back and forth across the lane as the machine moves linearly along the lane so that dressing is transferred to a buffer brush that engages the lane surface and applies the dressing thereto. The oil pattern is determined by actuation and deactuation of the dispensing head as it traverses the lane, such control of the head being provided by a special pattern control device in the nature of a cylindrical pattern tube that extends alongside the path of travel of the dispensing head. A sensor on the dispensing head detects pattern structure on the control device to responsively actuate and deactuate the head. In a preferred form, such structure takes the form of a series of metallic strips extending parallel to the path of travel of the dispensing head and spaced circumferentially around the periphery of the pattern tube. The sensor on the dispensing head is in the form of a proximity sensor that responds to the presence and absence of such metallic strips. At the end of each traverse of the dispensing head, the pattern tube is indexed one rotative increment to present the next strip into position for detection by the sensor during the succeeding traverse by dispensing head.

8 Claims, 14 Drawing Sheets

LANE MAINTENANCE MACHINE WITH MECHANICAL LANE DRESSING APPLICATION CONTROLLER

RELATED APPLICATIONS

This application claims the priority benefit of provisional application Serial No. 60/388,662, filed Jun. 12, 2002, incorporated into the present application by reference.

TECHNICAL FIELD

This invention relates to machines for applying dressings such as conditioning oil to the surface of bowling lanes.

BACKGROUND AND SUMMARY

Prior U.S. Pat. No. 5,729,855 assigned to the assignee of the present invention discloses a bowling lane conditioning machine utilizing a highly accurate, single head dressing dispenser that travels back and forth across the lane as the machine travels up and down the length of the lane. By controlling the times when the dispensing head is off and on, the pattern of dressing applied to the lane surface is likewise controlled. In the '855 patent such control is achieved by an electronic control system that includes a programmable logic controller, as well as other electronic components.

While machines incorporating the invention of the '855 patent have been highly successful, some users prefer a less sophisticated machine that does not require the level of skill necessary to operate and maintain a computer-based machine. Yet, there is a strong desire to retain the precision and accuracy associated with the single head design and the metering system that supplies dressing to the single head.

Accordingly, one object of the present invention is to provide a simpler, non-computer based lane maintenance machine that eliminates the level of sophistication associated with a computerized machine without sacrificing significant precision and accuracy. To this end, the present invention utilizes as the heart of the control system a mechanical control device carrying control structure thereon that is detectable by a sensor associated with the single dispensing head so that as the dispensing head moves back and forth across the lane during travel of the machine along the length of the lane, the sensor is responsive to the control structure to turn the dispensing head on and off in a manner that produces a predetermined pattern of dressing on the lane surface. In a preferred form of the invention, the control device is indexed one increment at the end of each traverse of the dispensing head along its path of travel so as to present a new portion of control structure on the device to the sensor. Preferably, the control device is in the form of an elongated, cylindrical member extending parallel to the path of travel of the dispensing head and rotatable through an indexing increment about the longitudinal axis of the member during each indexing action. In one preferred embodiment, the sensor is in the form of a proximity sensor traveling with the dispensing head and responsive to metallic strips on the peripheral surface of the control member. The strips extend along the length of the member for predetermined distances and are slightly spaced apart circumferentially around the member in accordance with the particular dressing pattern to be laid down.

In one preferred form, the metallic strips take the form of metallic tape, and the member comprises a cardboard core having an outer cardboard sleeve wrapped with a sheet of self-adhering plastic material to which the strips of metallic tape are applied. The outer sleeve with its plastic wrapper can be removably mounted on the core such that, when the control member is removed from the machine, the existing sleeve may be slipped off the core and replaced with a different sleeve having a different pattern of metallic control strips thereon so as to provide a correspondingly different pattern of dressing for the lane surface.

DETAILED DESCRIPTION

Figure 1:
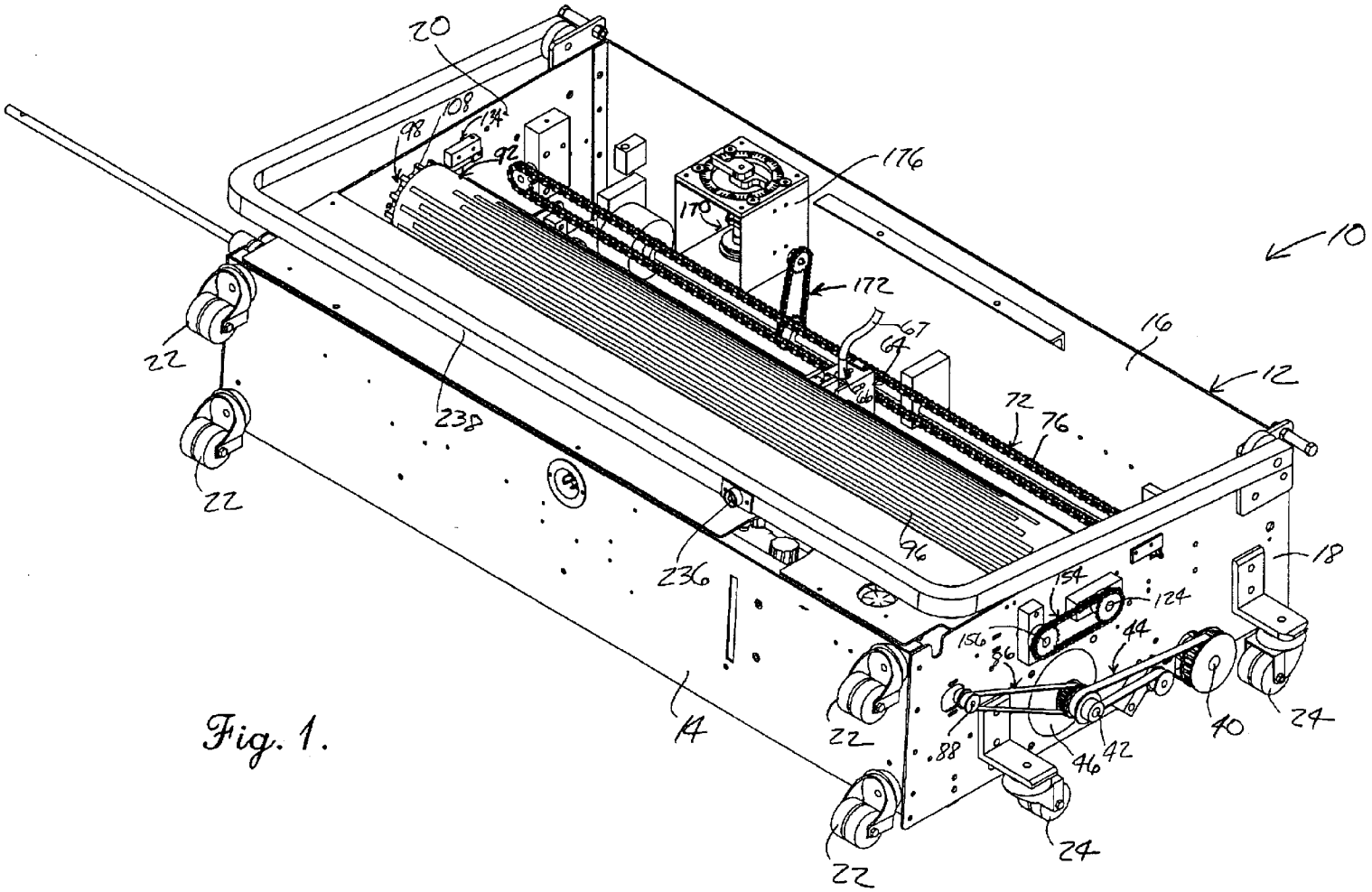
FIG. 1 is a left front isometric view of a lane conditioning machine constructed in accordance with the principles of the present invention.
Figure 2:
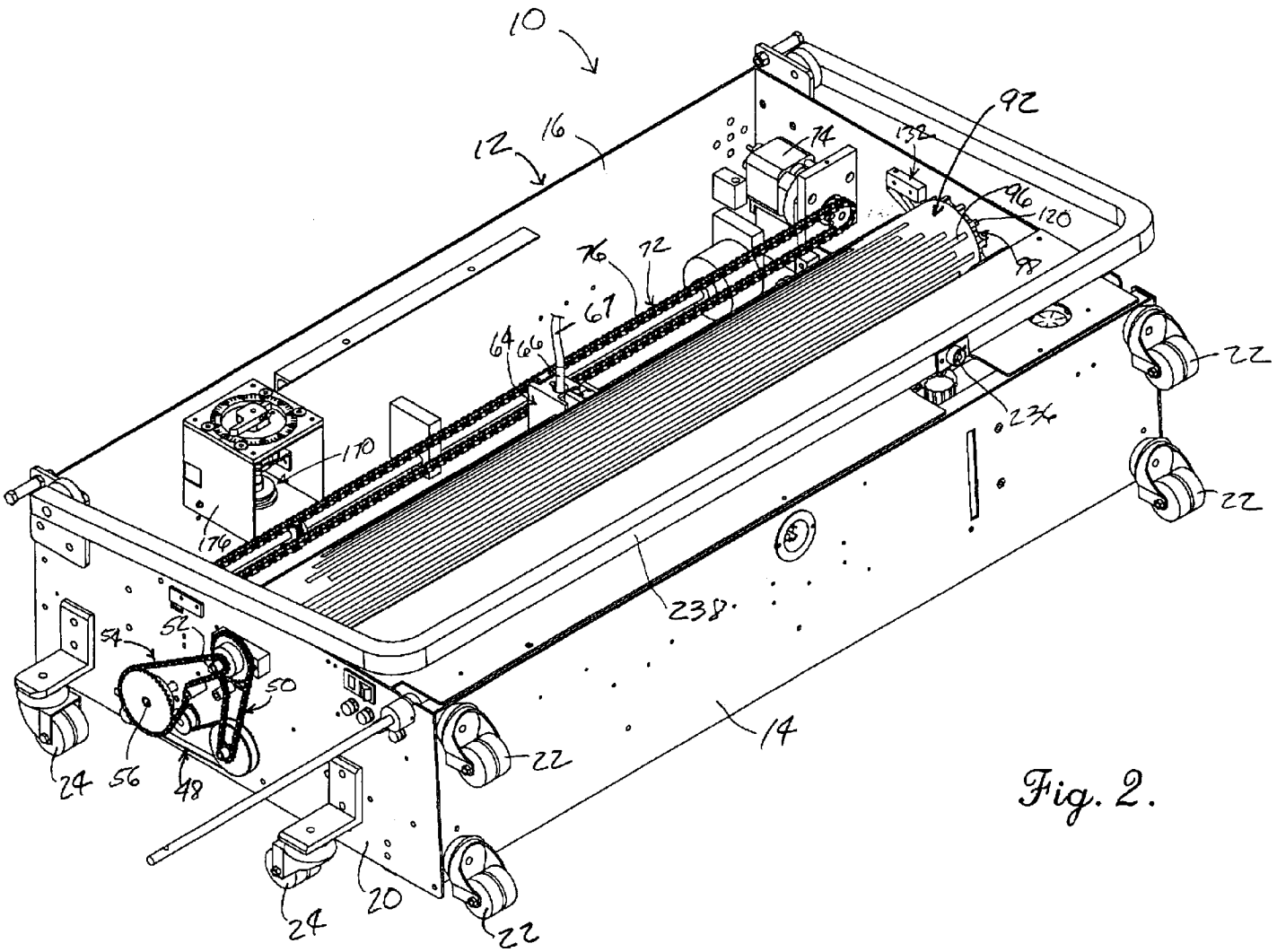
FIG. 2 is a right front isometric view of the machine.

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

In many respects the lane conditioning machine of the present invention is similar to the conditioning machine disclosed in U.S. Pat. No. 5,729,855. Therefore, the '855 patent is hereby incorporated by reference into the present specification.

Machine 10 includes a housing 12 having a front wall 14, a rear wall 16, a left sidewall 18, and a right sidewall 20. Although the housing also typically includes one or more top doors covering the open top of housing 12, such doors are not illustrated, to aid in revealing internal details. Four castor wheels 22 are mounted on front wall 14 to facilitate standing of the machine upright for transport to and from storage locations, and additional castor wheels 24 are mounted on sidewalls 18, 20 for supporting machine 10 in its operating position on the lane approach and elsewhere, such castor wheels 24 being disposed in left and right gutters of the lane during travel of the machine up and down the lane. Spring-loaded, conically-shaped guide wheels 25 on the inboard sides of left and right sidewalls 18, 20 engage the inboard surfaces of the gutters in operation to keep the machine centered on the lane during travel.

Figure 4:
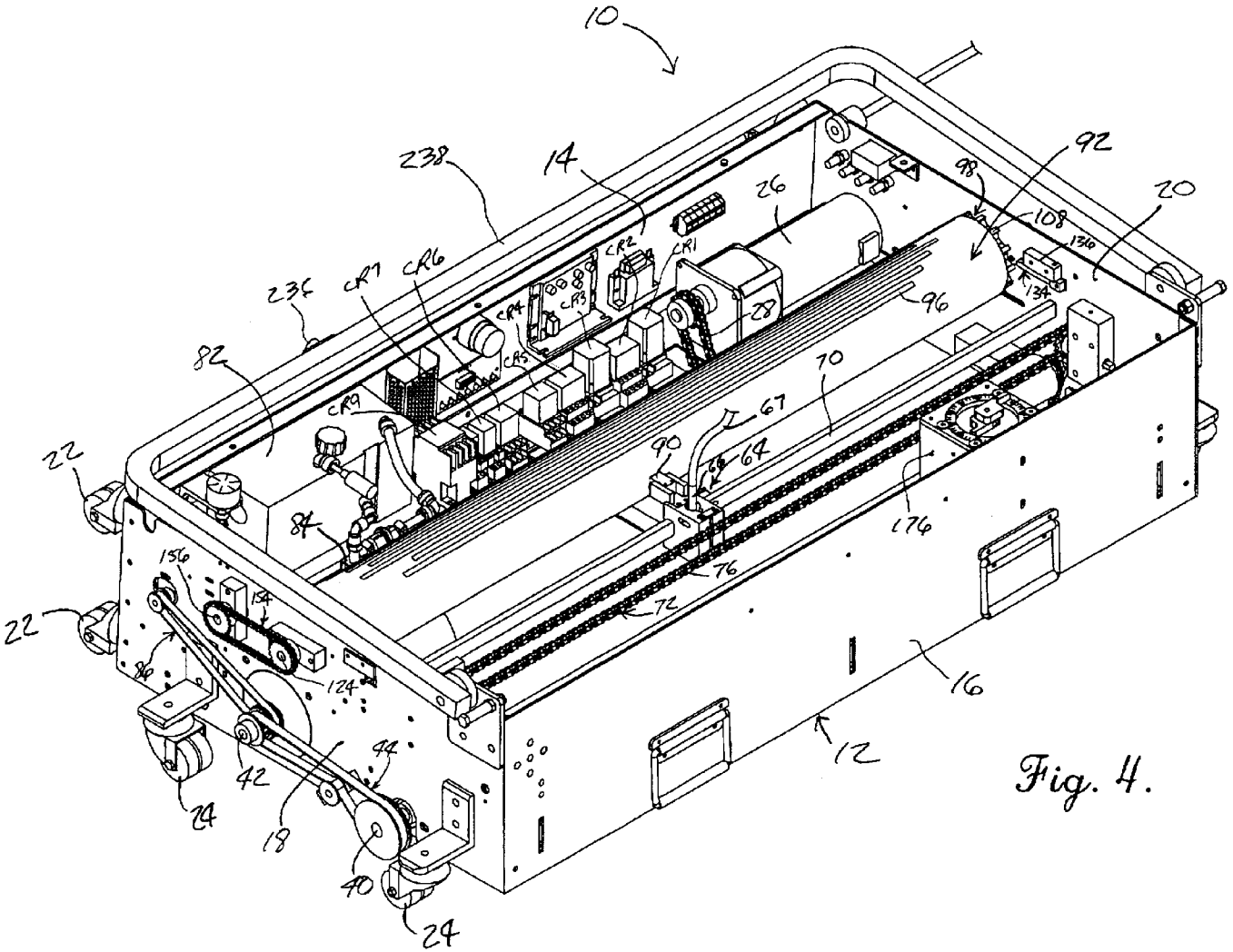
FIG. 4 is a left rear isometric view of the machine.
Figure 5:
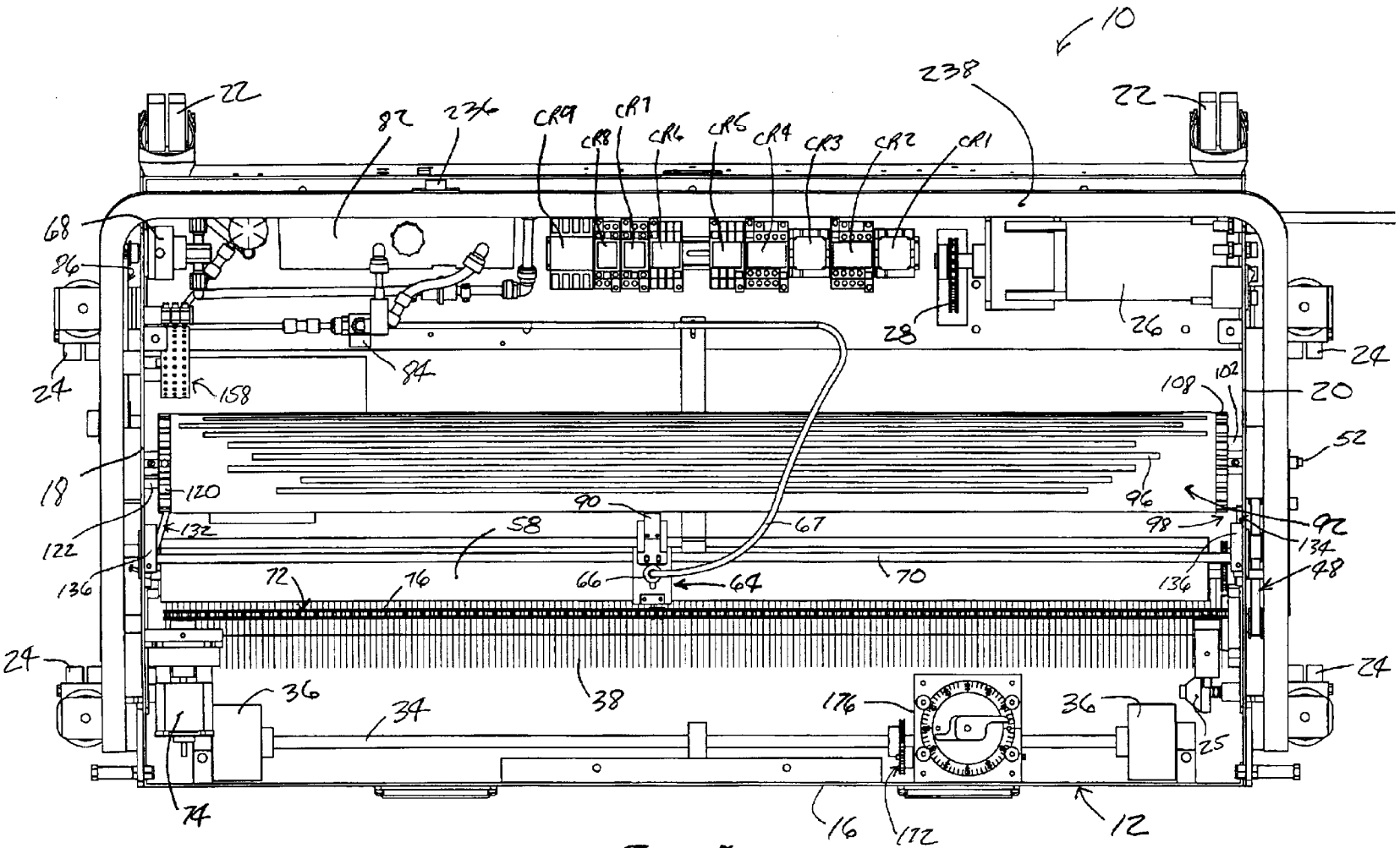
FIG. 5 is a top plan view of the machine.
Figure 6:
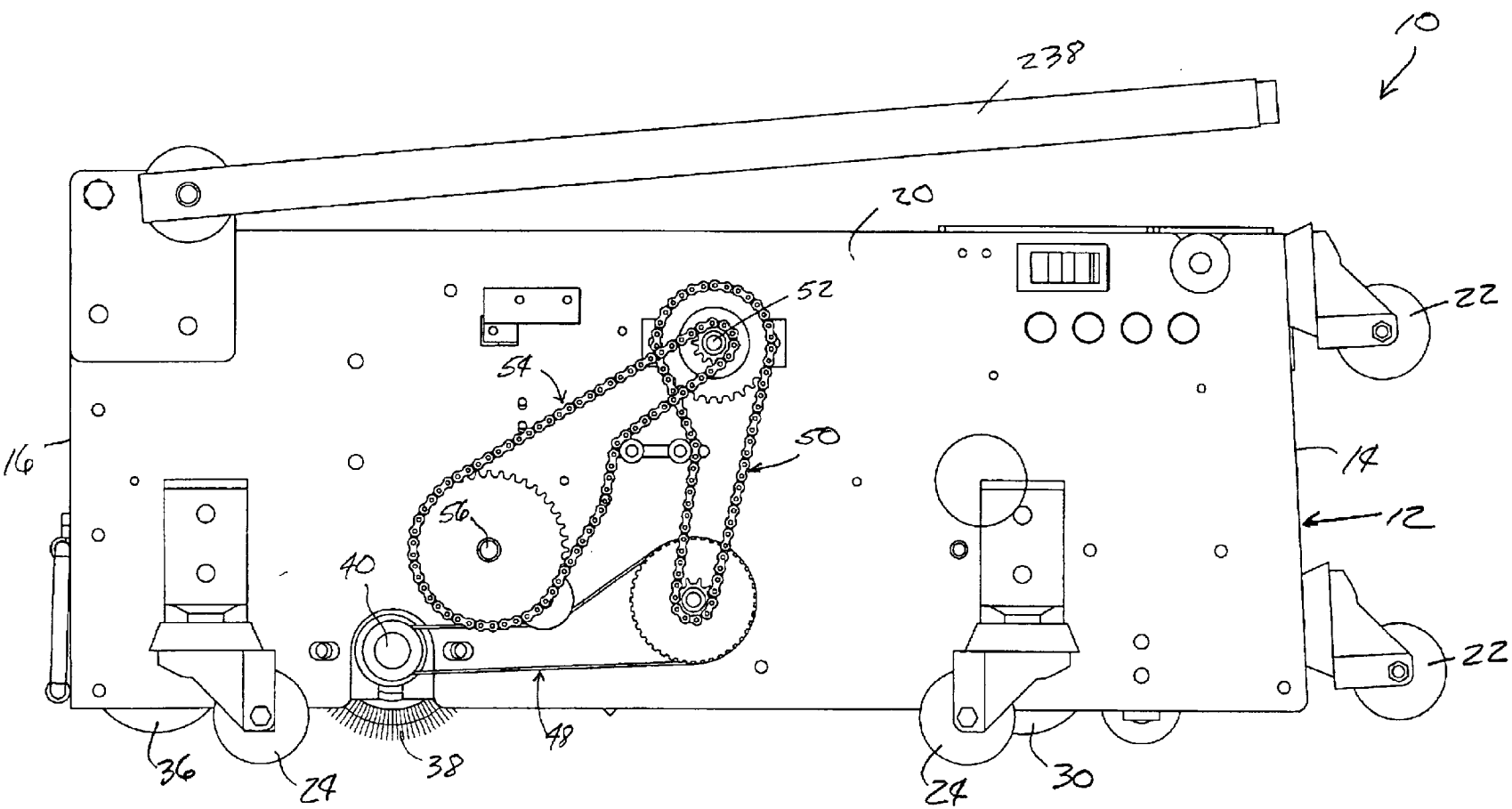
FIG. 6 is a right side elevational view of the machine.
Figure 7:
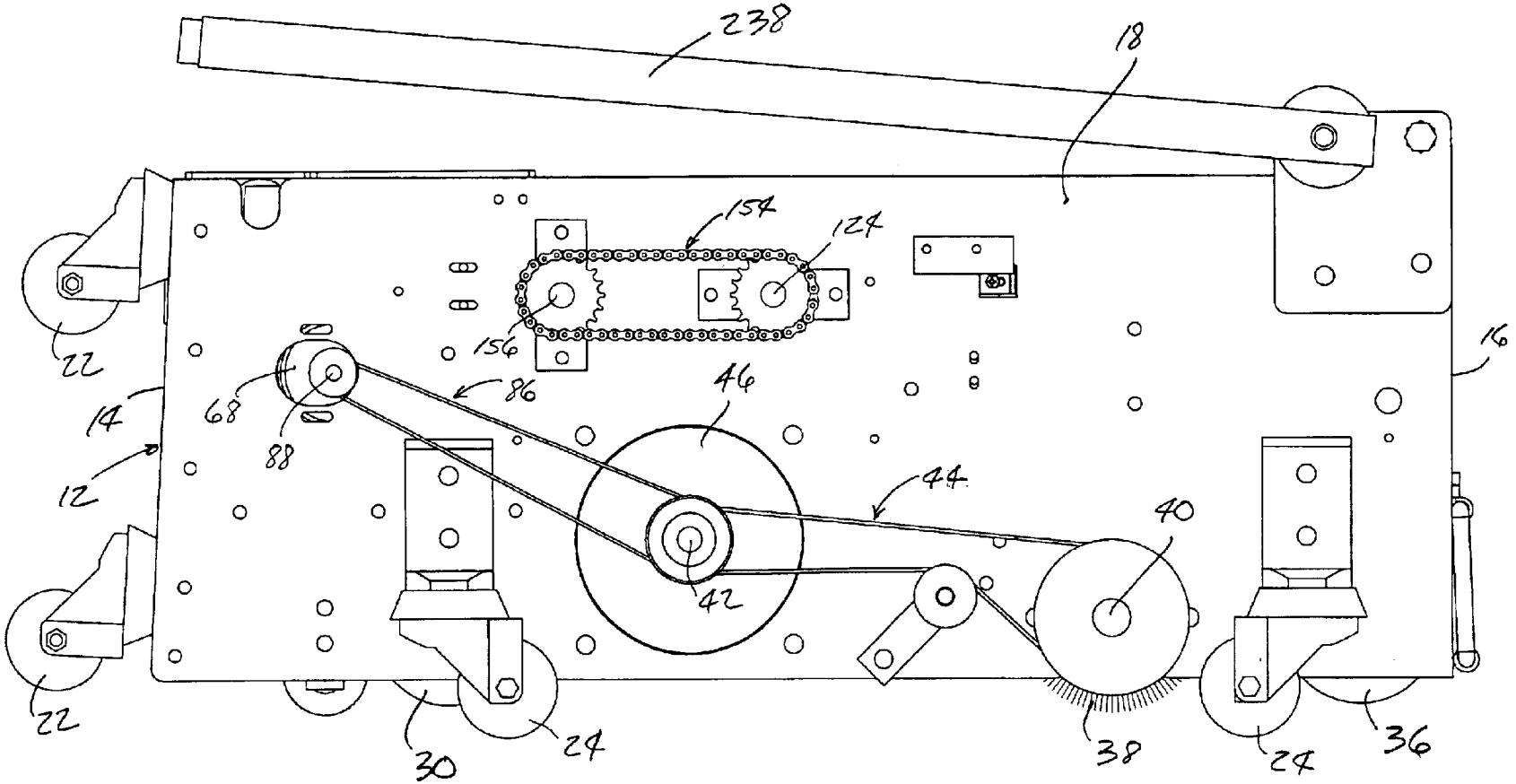
FIG. 7 is a left side elevational view of the machine.
Figure 8:
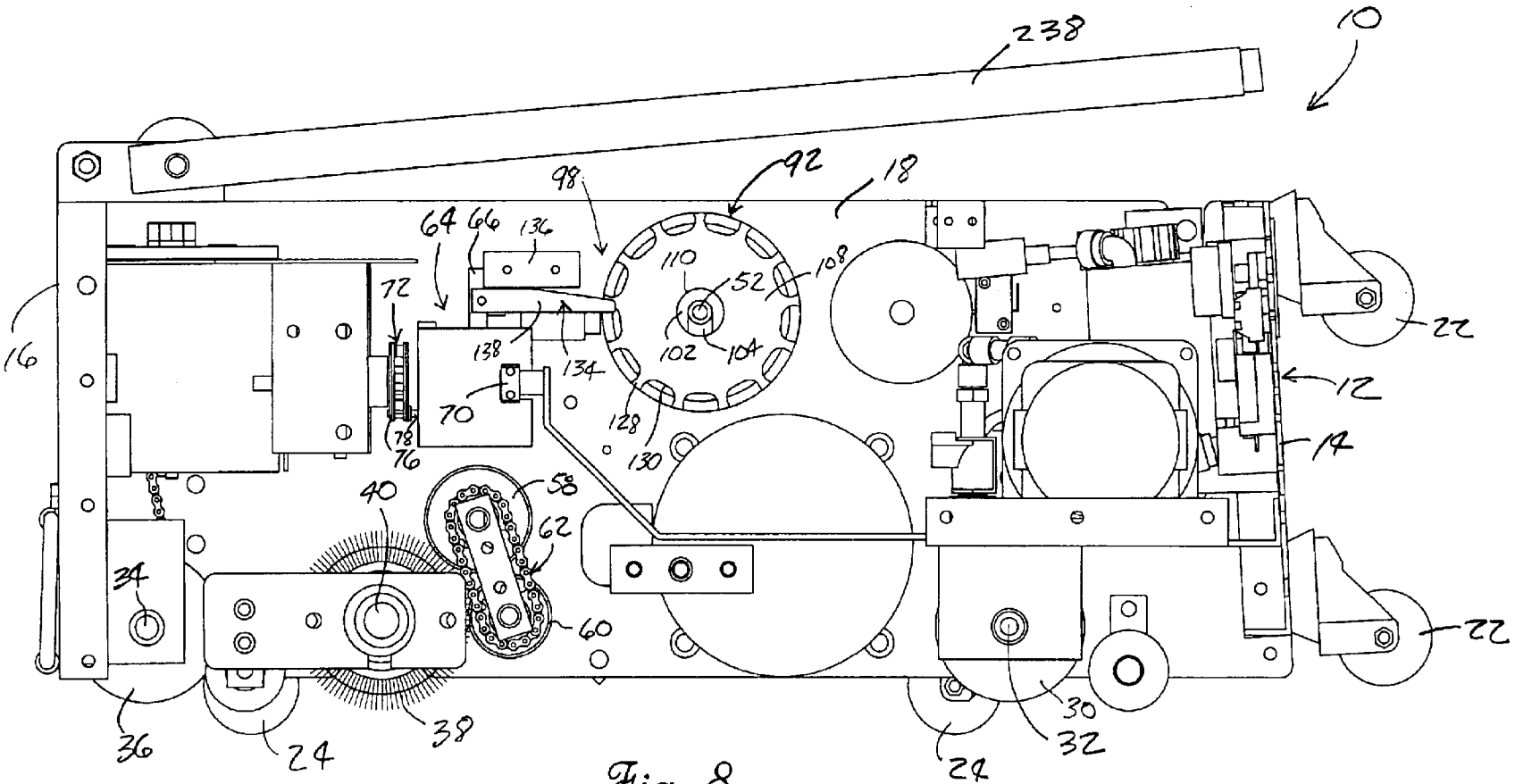
FIG. 8 is a right side elevational view of the machine with the right side wall removed to reveal internal details.

A reversible lane drive motor 26 (FIGS. 3, 4 and 5) is mounted within housing 12 adjacent front wall 14 and is operably coupled through a chain drive 28 with a pair of lane drive wheels 30 (FIGS. 6, 7, and 8) at opposite ends of a drive shaft 32. Adjacent the rear of the machine but inboard of rear wall 16 is disposed a cross shaft 34 having a pair of lane distance wheels 36 at opposite ends thereof. Lane drive wheels 30 and lane distance wheels 36 thus ride on the top surface of the lane and support housing 12 during its travel up and down the lane. Lane drive wheels 30 supply the driving power for the machine, while lane distance wheels 36 serve to provide distance input to certain control mechanism responsive to the distance that the machine has traveled up or down the lane, as will hereinafter be described in more detail.

A buffer or applicator roll 38 spans housing 12 in front of lane distance wheels 36 and is disposed to have its bristles engage the top surface of the lane as the machine travels up and down the lane. Buffer roll 38 has a shaft 40 that projects outwardly beyond left and right sidewalls 18, 20. On the left side of the machine, shaft 40 is operably coupled with a buffer motor shaft 42 by a cog belt drive assembly 44, the motor shaft 42 comprising the output shaft of a buffer motor 46 (FIGS. 3 and 7) on the inboard side of left sidewall 18. Thus, buffer motor 46 drives buffer roll 38 when motor 46 is operating.

On the right side of the machine, shaft 40 of buffer roll 38 is operably coupled via another cog belt drive assembly 48 to a speed reduction chain and sprocket assembly 50 that drives a stub shaft 52 projecting outwardly from right sidewall 20. Another chain and sprocket assembly 54 takes power from stub shaft 52 to a shaft 56 associated with an upper steel transfer roll 58 (FIG. 8) that receives lane dressing and transfers it to buffer roll 38. A lower steel transfer roll 60 (FIG. 8) receives driving power from a chain and sprocket assembly 62 (FIG. 8) just inboard of right sidewall 20 and operably coupled with upper transfer roll 58. Lower steel transfer roll 60 serves to smooth and even out the oil or other dressing applied to buffer roll 38.

Figure 11:
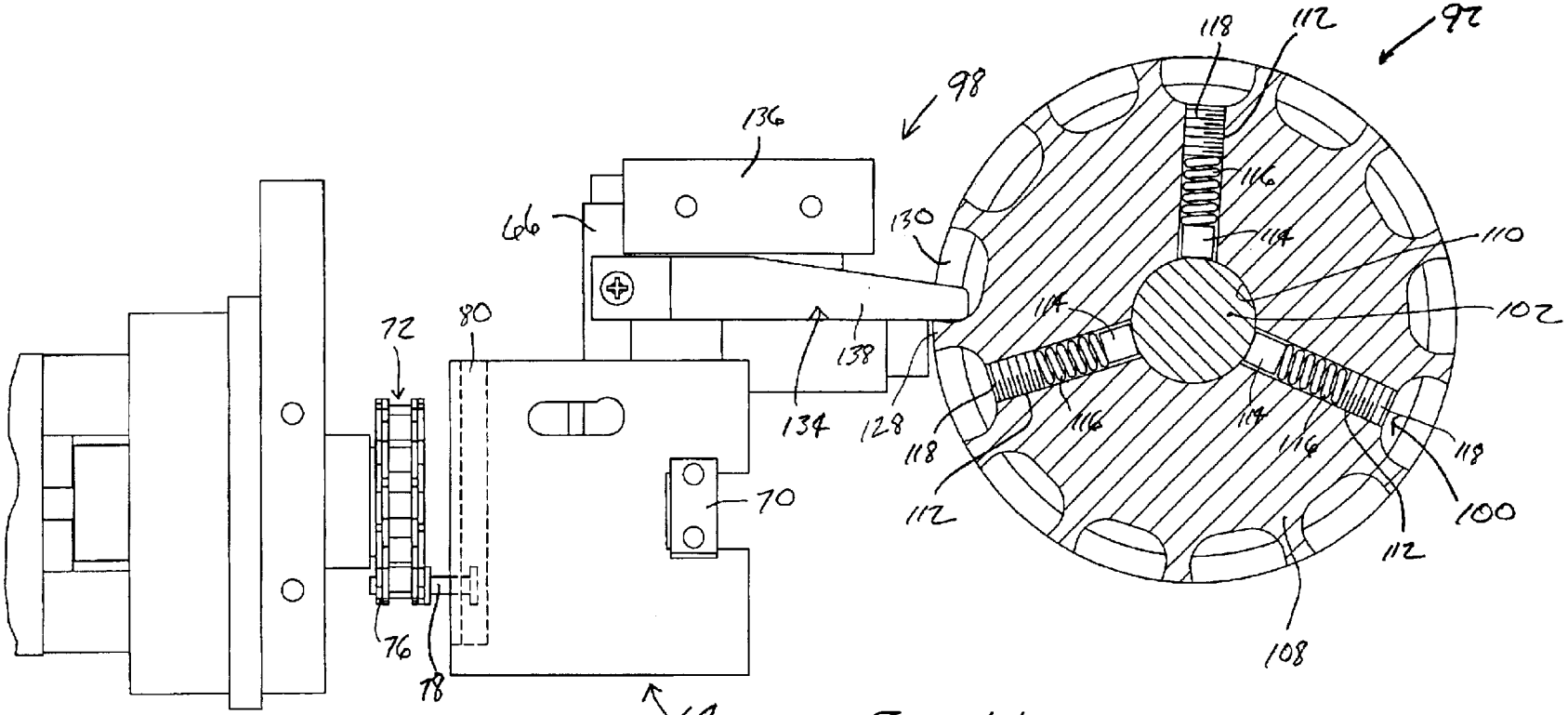
FIG. 11 is an enlarged, fragmentary, end elevational view of the right end of the pattern tube and associated mechanism.
Figure 12:
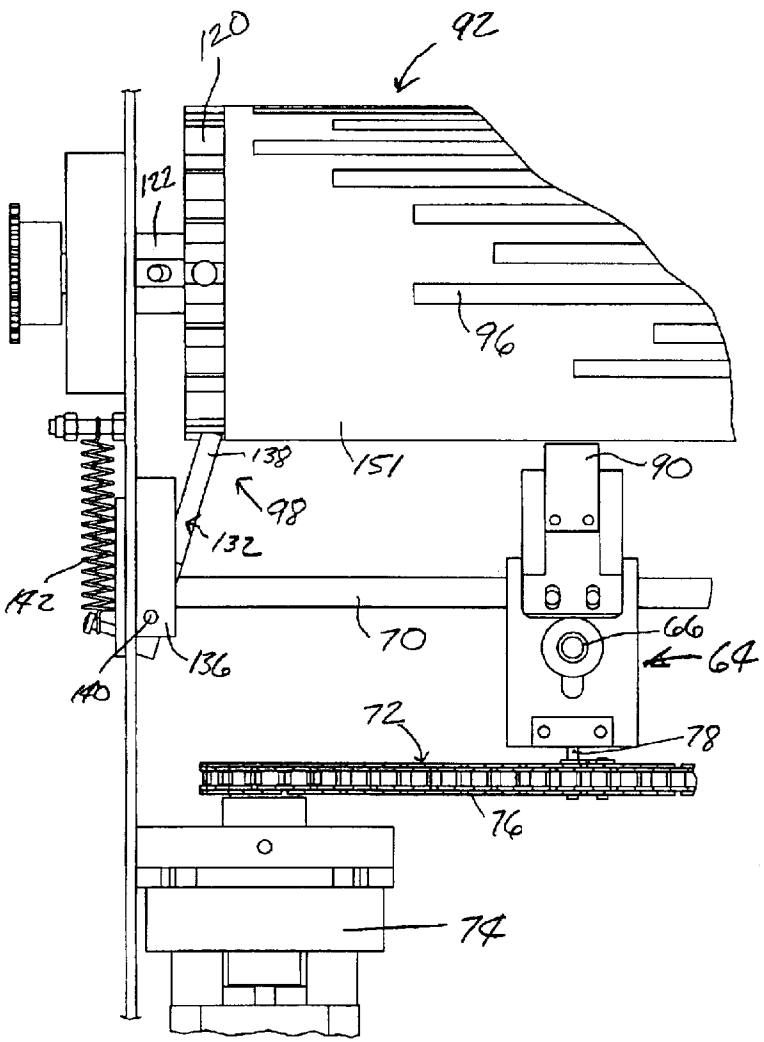
FIG. 12 is an enlarged, fragmentary top plan view of the left end of the pattern tube and associated mechanism.

A dressing dispensing head 64 is mounted above upper transfer roll 58 for reciprocation along a transverse path of travel parallel with transfer roll 58. Head 64 includes an upright dispensing tube or nozzle 66 which is connected via supply tubing 67 to a dressing supply pump 68 (FIGS. 3 and 5) located on the inboard side of left sidewall 18 near the front of the housing 12. Dispensing head 64 is slidably mounted on a transverse guide bar 70 spanning housing 12 above upper transfer roll 58 and is driven back and forth along guide bar 70 by a chain drive assembly 72 operably coupled with a dispensing head drive motor 74 adjacent the left rear corner of housing 12. Drive chain assembly 72 includes an endless chain 76 that receives driving output from drive motor 74, the chain 76 having affixed thereto a generally T-shaped drive peg 78 (FIGS. 8, 11 and 12) that fits down into a vertically oriented, complementally shaped guide channel 80 in the backside of dispensing head 64. Thus, as drive chain 76 is continuously driven by motor 74, drive peg 78 serves as the means for operably coupling head 64 with chain 76 to reciprocate head 64 along guide bar 70. As guide peg 78 reaches one end of its path of travel, it simply moves around the sprocket with drive chain 76 while simultaneously moving in vertical guide channel 80 (FIGS. 9 and 11) and then travels in the opposite direction while remaining coupled with head 64. Thus, motor 74 is not reversed, but instead continuously operates in the same direction even though guide peg 78 within guide channel 80 enables dispensing head 64 to reverse its direction of movement at each end of its path of travel.

Lane dressing is supplied to dispensing head 64 by the pump 68 that is in turn supplied by a reservoir 82 on the inboard side of front wall 14. An electrically operated 3-way valve 84 (FIG. 5) downstream from pump 68 is shiftable between recycle and delivery positions for delivering dressing to head 64 when valve 84 is in its delivery position and for recycling oil back to reservoir 82 when valve 84 is in its recycle position. Pump 68 is a positive displacement pump and is continuously driven by a cog belt drive assembly 86 on the left side of housing 12 that is operably coupled with output shaft 42 of buffer motor 46. An input shaft 88 of pump 68 projects outwardly beyond left sidewall 18 for operable connection with cog belt drive assembly 86.

Opening and closing of dressing supply valve 82 is controlled by a sensor 90 mounted on and movable with dispensing head 64. Preferably, sensor 90 comprises a metal-sensing proximity sensor (Omron TL-Q5MC1) that effectively actuates and deactuates dispensing head 64 such that head 64 dispenses dressing when actuated and refrains from dispensing dressing when in a deactuated condition.

Actuation and deactuation of dispensing head 64 is further controlled by a control device broadly denoted by the numeral 92. Control device 92 is provided with a certain pattern of structure thereon that is detectable by sensor 90, thereby controlling by actuation and deactuation of dispensing head of 64 to produce a pattern of lane dressing on the top surface of the lane that is related to the pattern of control structure on control device 92. In its preferred form, control device 92 comprises a cylindrical member that spans housing 12 and extends alongside of the path of travel of dispensing head 64 so that sensor 90 can react to the control structure on device 92 during reciprocation of dispensing head 64. Preferably, such control structure comprises a series of metallic strips 96 extending along the length of control device 92 and spaced circumferentially about the same to present a particular dressing pattern. Sensor 90 detects the presence of each particular metallic strip 96 and causes dispensing head 64 to assume an actuated condition when the presence of such a strip is detected, and a deactuated condition when the absence of a metal strip is sensed by sensor 90.

Preferably, control device 92 is mounted for rotation about its longitudinal axis in an incremental indexing movement that occurs each time dispensing head 64 reaches one end of its path of travel. Thus, control device 92 indexes one increment for each single traverse of dispensing head 64 across the lane in one direction. As one alternative to metallic strips 96, the control structure on device 92 may, for example, simply take the form of a pair of metallic protrusions or other components adjacent opposite ends of the device 92. Control valve 84 could thus be operated in such a manner that when sensor 90 senses the presence of the first metallic protrusion, dispensing head 64 would be actuated to dispense dressing. Head 64 would then remain in the actuated condition until the sensor detected the second metallic protrusion at the opposite end of the control device 92, whereupon dispensing head 64 would be deactuated. Of course, after indexing one increment for the return travel of dispensing head 64, the head 64 would be actuated and deactuated in its return path of travel in the opposite order.

In its preferred form, control device 92 takes the form of a cylindrical, tubular member which, for convenience, will hereinafter be referred to as the "pattern tube" 92. In order to carry out the incremental indexing function of pattern tube 92, indexing mechanism broadly denoted by the numeral 98, and including components at both ends of tube 92, is provided. Indexing mechanism 98 works in conjunction with a slip clutch 100 (FIGS. 9 and 11) at the right end of pattern tube 92 for periodically operably connecting pattern tube 92 with a source of rotary driving power to index pattern tube 92 one increment. More specifically, it will be seen that the stub shaft 52 at the right end of housing 12 is constantly rotating as long as buffer drive motor 46 is energized. Stub shaft 52 supplies the power for rotating pattern tube 92, but such rotation is only through a very short increment of angular rotation, and thus slip clutch 100 must be present to allow continued rotation of stub shaft 52 during the intervals between consecutive indexing movements of pattern tube 92.

Slip clutch 100 includes a relatively short, generally cylindrical clutch hub 102 (FIGS. 8 and 9) that has an axially extending notch 104 in its sidewall to allow hub 102 to be fitted transversely off and on the inboard portion of stub shaft 52. A set screw 106 passes transversely through hub 102 and releasably secures the same to stub shaft 52. Thus, clutch hub 102 rotates continuously with stub shaft 52. A disc 108 is fixed to the end of pattern tube 92 for rotation therewith and is provided with a central hole 110 that rotatably receives clutch hub 102. Three radially extending bores 112 in disc 108 house corresponding, cylindrical clutch pads 114 that bear against the peripheral surface of clutch hub 102 to provide a friction coupling between pattern tube 92 and input shaft 52. Each clutch pad 114 is yieldably urged against the surface of clutch hub 102 by a coil compression spring 116, which in turn is retained in position by a set screw 118 threadably received in the outer portion of bore 112. The frictional engagement between clutch pads 114 and clutch hub 102 is such that stub shaft 52 is capable of rotatably driving pattern tube 92 when tube 92 is not held against such rotation by an external force, but when pattern tube 92 is so restrained, clutch pads 114 merely slip on the exterior surface of clutch hub 102 as its rotates with stub shaft 52.

The opposite, left end of pattern tube 92 does not receive driving input power and has no slip clutch. In many respects, however, the left end of pattern tube 92 is similar to the right, driven end. In this regard, it will be noted that the left end of pattern tube 92 also has a disc 120 affixed thereto for rotation therewith, as well as a hub 122 and a stub shaft 124 (FIG. 10) received in hub 122. A set screw 126 releasably secures hub 122 to stub shaft 124 such that those two components rotate together.

However, unlike disc 108 on the right end of pattern tube 92, disc 120 on the left end of pattern tube 92 has no bores 112 or slip clutch components. In fact, disc 120 and hub 122 are fixed to one another by means not illustrated such that there is never relative rotation between disc 120 and hub 122. Whenever pattern tube 92 is rotated through an indexing motion, disc 120, hub 122 and stub shaft 124 all move together as a unit.

Indexing mechanism 98 includes components at both ends of pattern tube 92. In this respect, it will be noted that each of the discs 108, 120 is serrated about its circumferential periphery so as to present alternating teeth 128 and notches 130. In the illustrated embodiment, each disc 108, 120 has a total of 13 teeth and 13 notches about its outer circumference. Teeth 128 are all equally spaced apart.

In addition to teeth 128 and notches 130, indexing mechanism 98 also includes a pair of releasable retainers 132 and 134 at opposite ends of pattern tube 92 and secured to respective left and right sidewalls 18 and 20 (see in particular FIGS. 8–12). Each retainer 132, 134 includes a mounting block 136 secured to the inside surface of the corresponding sidewall, a retaining lever 138 disposed below block 136 and pivoted thereto by an upright pin 140, and a tension spring 142 connected to retaining lever 138 in such a way that the lever is yieldably biased inwardly away from the corresponding sidewall 18 or 20. Each retaining lever 138 extends forwardly a sufficient distance to have its forwardmost tip overlapping the marginal periphery of the corresponding disc 108 or 120 such that spring 142 biases such tip into a proximal notch 130 of the disc 108 or 120. Each retaining lever 138 can be swung against the restoring force of spring 142 out of the notch 130 and toward the proximal sidewall so as to be in a released position with respect to pattern tube 92.

Each of the notches 130 is at least double the width of the tip of the corresponding retaining lever 138, i.e., the distance between successive teeth 128 is at least twice the width of each retaining lever tip. In addition, discs 108 and 120 are slightly rotatively offset from one another, i.e., by an amount corresponding to one half the distance between successive teeth 128. Thus, even though most of the time both retaining levers 138 are swung inwardly to their retaining positions within a notch 130 and abutting the corresponding end extremity of pattern tube 92, only one of such levers 138 is actually retaining pattern tube 92 against rotation at any point in time. Only one of such levers 138 is in engagement with a tooth 128, while the other lever 138 is simply received within a notch 130 but out of engagement with the next tooth in view of the circumferentially offset relationship of the disc 108 and 120.

The constantly rotating input stub shaft 52 continuously tries to rotate pattern tube 92. However, when the retaining levers 138 are in their retaining positions, one or the other of them is engaged by the leading extremity of a tooth 128 of the disc 108 or the disc 120. Thus, until the retaining lever that is engaged by a tooth is moved to its released position, pattern tube 92 is not allowed to rotate at all, and slip clutch 100 simply allows stub shaft 52 to keep rotating while pattern tube 92 is held motionless. When the particular lever 138 that is engaged by a tooth 128 is shifted to its released position, the frictional force between pads 114 of slip clutch 100 and clutch hub 102 is sufficient to enable stub shaft 52 to rotate pattern tube 92 through one indexing increment, i.e., until the next tooth 128 at the opposite end of pattern tube 92 comes into engagement with the retaining lever 138 that was previously not yet engaged by the tooth. Each indexing increment of rotation thus corresponds to one-half the distance between a pair of teeth 128 considering that there are 13 notches 130 on each disc 108 and 120. Pattern tube 92 thus has room for a total of 25 metallic strips 96 around the circumference of tube 92, plus one final empty location so that the machine always starts up without any dressing being dispensed during a first pass of the dispensing head 64.

As noted above, retaining levers 138 are normally disposed in their retaining positions under the urging of tension springs 142. However, lever 138 of retainer 132 is located within the path of travel of dispensing head 64 as head 64 reaches the left end of its path of travel. Similarly, lever 138 of retainer 134 is disposed within the path of travel of head 64 as head 64 reaches the right end of its path of travel. Accordingly, as dispensing head 64 continuously reciprocates back and forth along guide bar 70 as the machine operates, head 64 momentarily releases lever 138 of retainer 132 when head 64 is at the left end of its path of travel, thus permitting pattern tube 92 to index one increment and, correspondingly, head 64 momentarily releases lever 138 of retainer 134 when head 64 reaches the right end of its path of travel to thereby index pattern tube 92 one additional increment.

Figure 9:
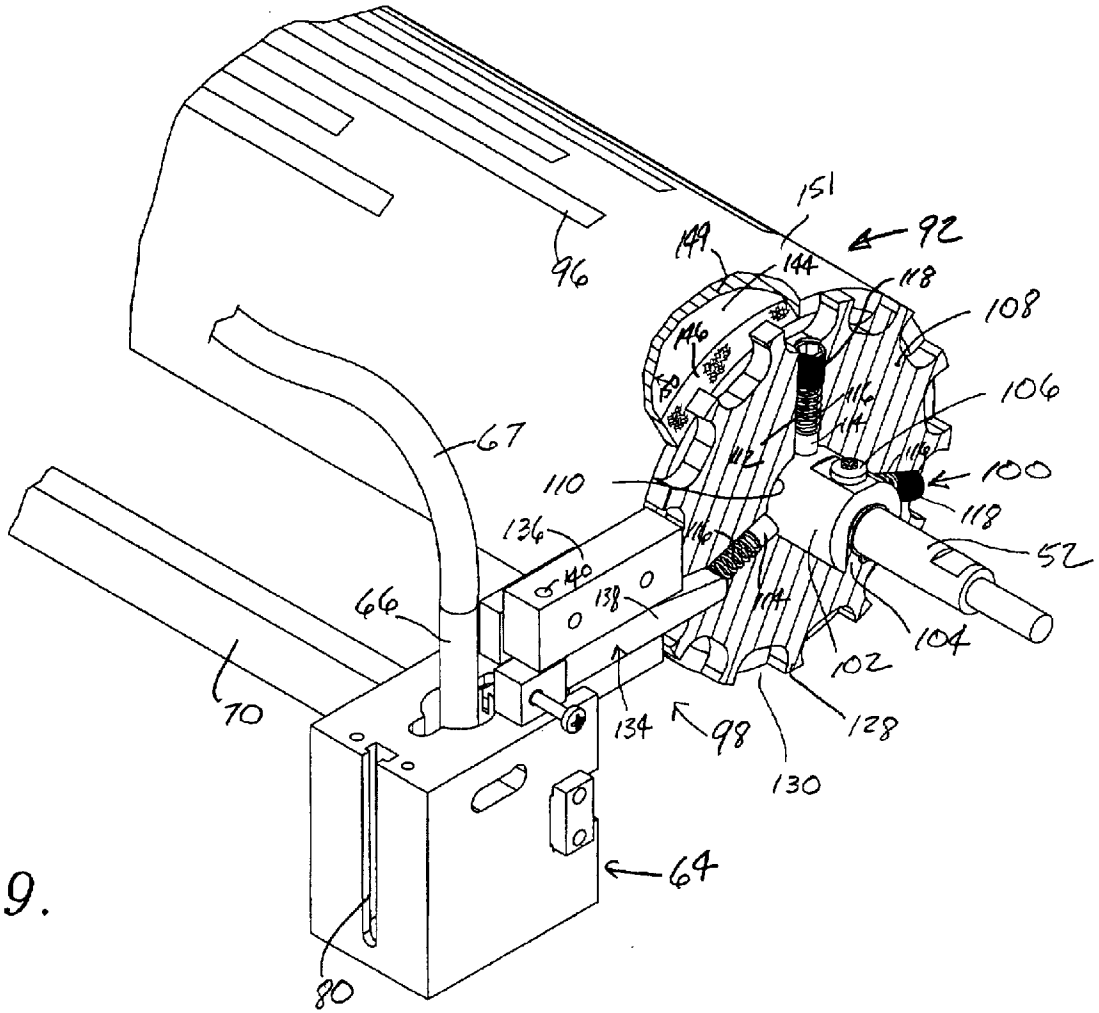
FIG. 9 is an enlarged fragmentary isometric view of the right end of the pattern tube illustrating details of construction, the indexing disc on the end of the pattern tube being illustrated in cross section to reveal details of construction.
Figure 10:
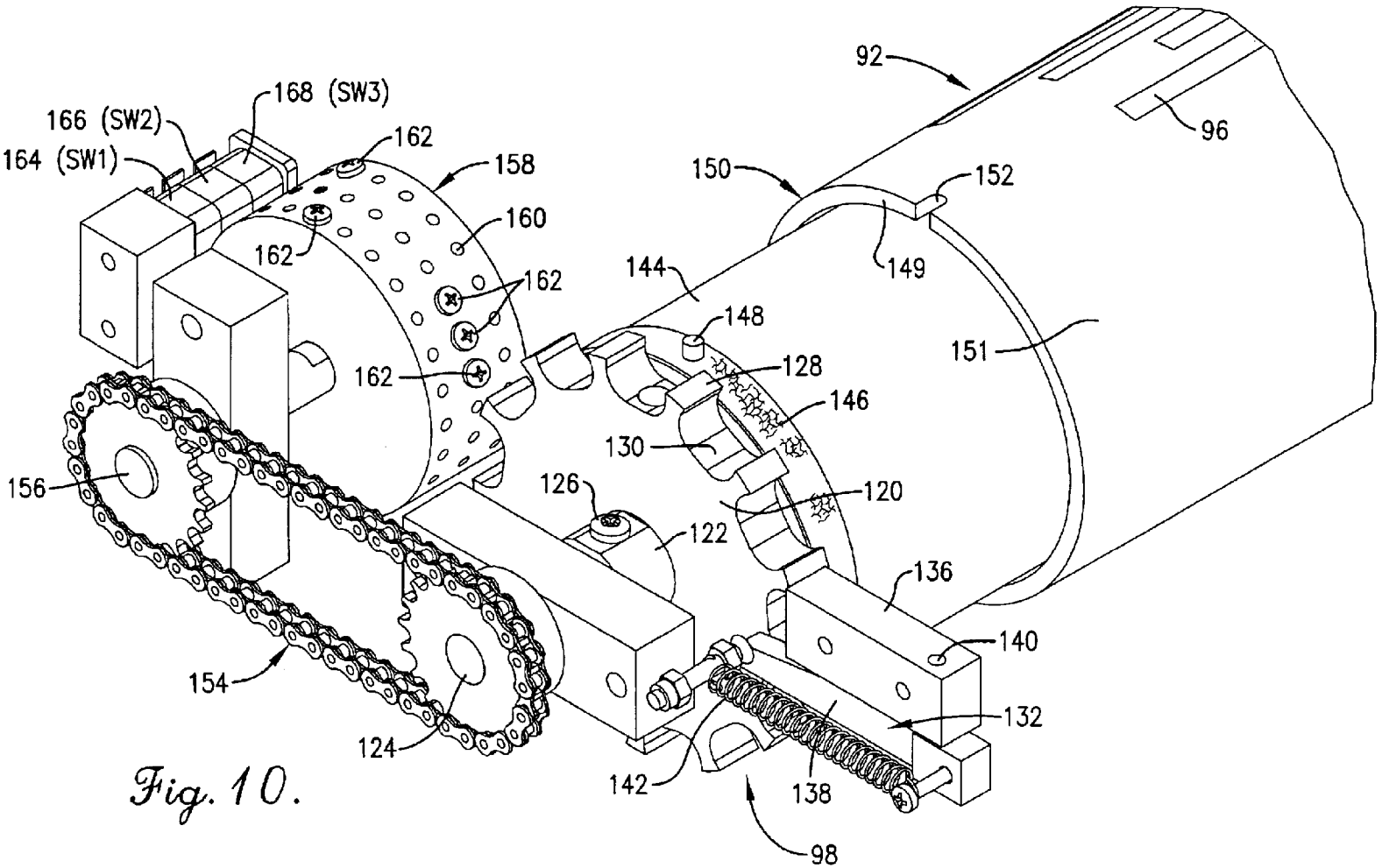
FIG. 10 is an enlarged, fragmentary isometric view of the left end of the pattern tube and associated mechanism showing details of construction.

Pattern tube 92 in one preferred form has a spiral-wound cardboard tubular core 144 (FIGS. 9 and 10). A band of loop pile fabric 146 provided with an adhesive back is attached to each end of core 144 to encircle such region immediately inboard of the discs 108, 120. A locating and locking pin 148 projects radially outwardly through band 146 at the left end of pattern tube 92, and a sleeve assembly 150 encircles core 144 and extends the full length thereof including the bands 146. Sleeve assembly 150 includes a cardboard sleeve 149 and a plastic wrapper 151 wrapped around sleeve 149 and adhered thereto by a suitable adhesive. The inside diameter of sleeve 149 is only slightly greater than the outside diameter of core 144 so that sleeve assembly 50 fits snugly on core 144, particularly in the end regions where bands 146 are located. Peg 148 fits into a locating notch 152 (FIG. 10) in the proximal end edge of sleeve assembly 150 for rotatively orienting sleeve assembly 150 on core 144 and preventing accidental rotation of sleeve assembly 150 relative to core 144 during operation. Metallic strips 96 may comprise strips of aluminum tape with an adhesive backing so that the strips are easily adhered to wrapper 151.

At the left side of the machine the stub shaft 124 from pattern tube 92 projects outwardly through left sidewall 18 and is operably coupled at that location via a chain and sprocket assembly 154 with a driven stub shaft 156 that extends back inwardly through left sidewall 18 to the inside of housing 12 where it is affixed to a switch wheel 158 (detailed in FIG. 10). Thus, each time pattern tube 92 is indexed one increment, switch wheel 158 is simultaneously indexed one increment.

Switch wheel 158 has three rows of drilled and tapped holes 160 (FIG. 10) about its circumference. Each row has a total of twenty-six holes 160 corresponding to the twenty-five locations for metallic strips along pattern tube 92, plus one empty location. Screws 162 may be threaded into holes 160 to serve as mechanical projections for operating a bank of three control switches 164 (SW1), 166 (SW2) and 168 (SW3) located in front of switch wheel 158 in close proximity thereto. The number of screws 162 in each row and their particular locations determine the frequency of actuations of switches 164 (SW1), 166 (SW2) and 168 (SW3).

Switch 164 (SW1) controls actuation and deactuation of the dispensing head drive motor 74, switch 166 (SW2) maintains dispensing head operation until switch 164 is fully off its initial actuating screw, and switch 168 (SW3) controls the forward speeds of the machine, such forward speeds preferably consisting of a first slower speed and a second faster speed. The first speed will operate as long as switch 168 (SW3) does not come into contact with an actuating screw. Once such contact is made, the machine will shift into a second faster speed and will maintain such speed so long as screws continue to come into engagement with switch 168 (SW3) during the indexing rotations of switch wheel 158.

Figure 13:
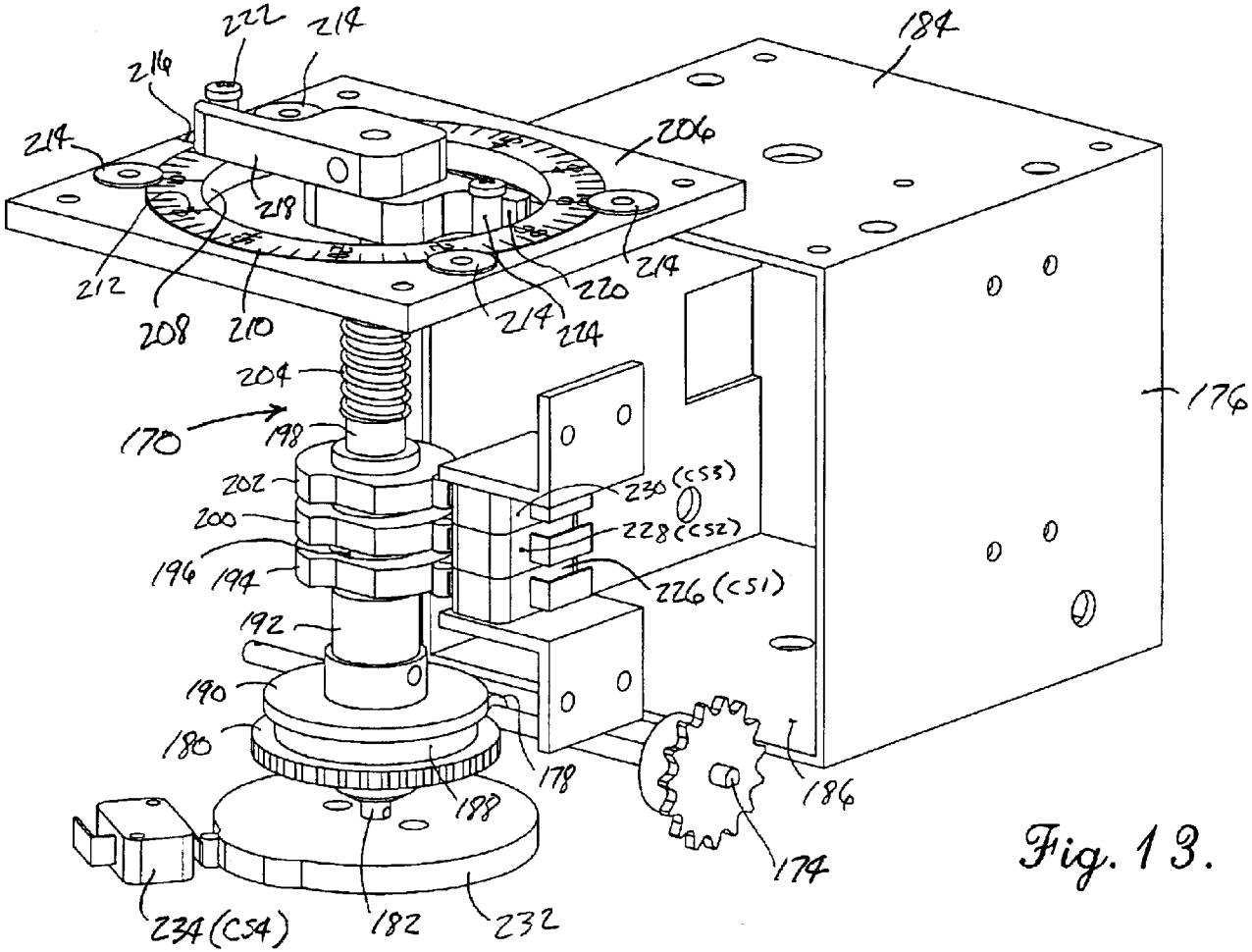
FIG. 13 is an enlarged exploded isometric view of the lane distance control box of the machine.
Figure 14:
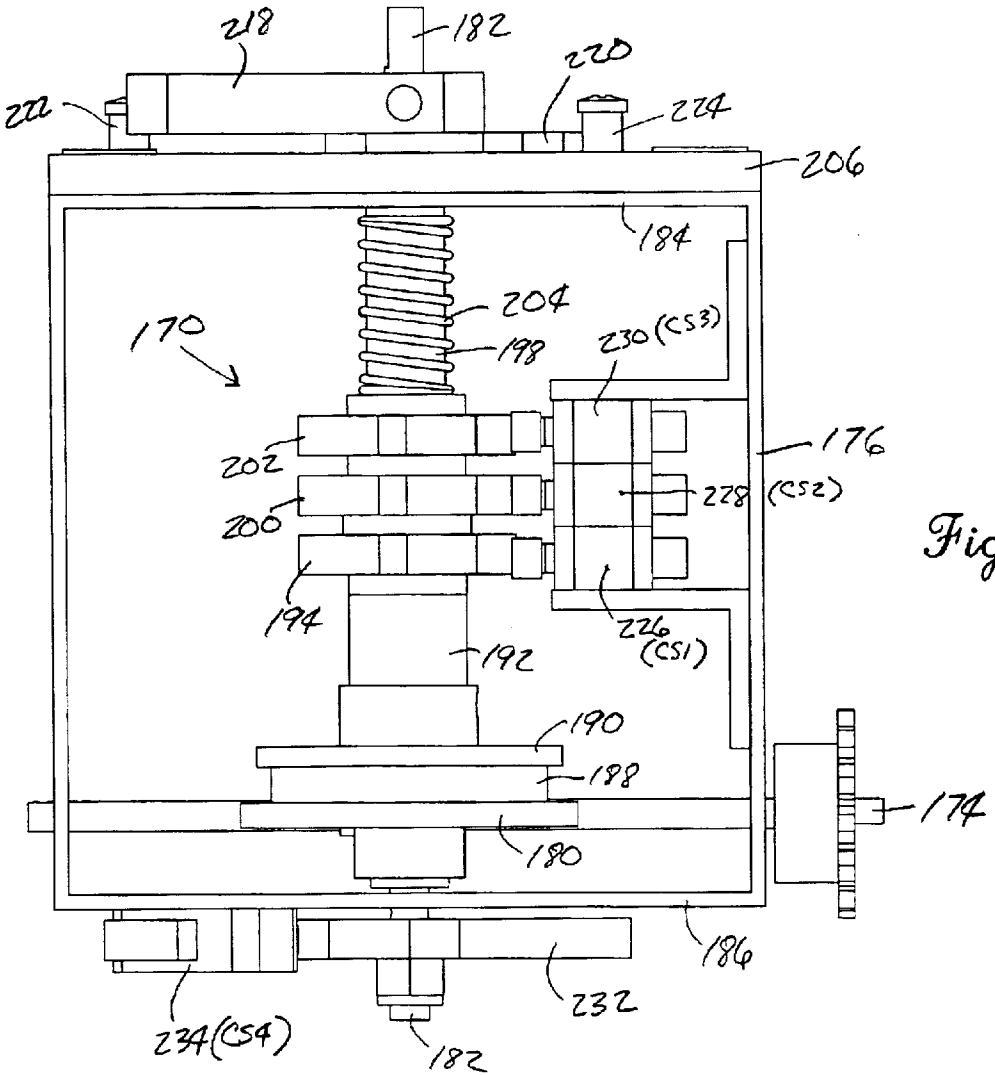
FIG. 14 is an enlarged elevational view of the lane distance control box showing components thereof in their normal operating relationships.

At the rear of the machine mounted on the inside surface of backwall 16 is a cam assembly 170 (detailed in FIGS. 13 and 14) for performing a number of switching functions in response to distance traveled by the machine up and down the lane. In order to provide input to cam assembly 170, cross shaft 34 associated with lane distance wheels 36 is operably coupled via a chain and sprocket assembly 172 (FIGS. 1 and 5) with an input shaft 174 projecting from one side of a box 176 that contains many of the components of cam assembly 170. Input shaft 174 has a worm 178 on its inner end that drivingly engages a gear 180 that is rotatable about an upright axis within box 176.

Gear 180 rotatably receives an upright shaft 182 passing through the top 184 and bottom 186 of box 176 and journaled for rotation thereby. Although gear 180 rotatably receives shaft 182, it is normally operable to rotate shaft 182 through a friction clutch comprising a rubber disc 188 overlying gear 180 and sandwiched between the latter and an overhead metallic clutch plate 190 that is fixed to upright shaft 182. Also fixed to shaft 182 immediately above clutch plate 190 are a hub 192 and a forward distance cam 194. Another rubber clutch disc 196 overlies forward distance cam 194 on shaft 182.

Above clutch disc 196, shaft 182 passes upwardly through a larger shaft 198 that concentrically receives shaft 182. Shaft 198 projects upwardly through top wall 184 of box 176 and terminates somewhat below the upper termination of shaft 182. The larger diameter shaft 198 has a reverse distance cam 200 fixed thereto adjacent its lower end immediately above rubber disc 196 such that disc 196 is sandwiched between reverse distance cam 200 and forward distance cam 194. A reverse speed switch cam 202 is fixed to larger diameter shaft 198 immediately above reverse distance cam 200, and a coiled compression spring 204 encircles shaft 198 above reverse speed cam 202 to apply a compressive force to the stack of clutch discs, hubs and cams 180, 188, 190, 192, 194, 196, 200 and 202 so that sufficient frictional force is provided against rubber clutch discs 188 and 196 to cause the entire stack to rotate together when lane distance wheels 36 are rotating.

As earlier noted, both the smaller diameter shaft 182 and larger diameter 198 project upwardly beyond and through top wall 184 of box 176. A cover plate 206 overlies and is secured to top wall 184, the cover plate 206 having a large diameter central opening 208 that concentrically receives shafts 182 and 198. An annular dial 210 having indicia 212 thereon corresponding to lane distance travel in feet is adjustably, rotatably affixed to the top of cover plate 206 by a plurality of releasable fasteners 214 and is disposed in concentric relationship with opening 208. A mark 216 on the top surface of cover plate 206 provides a point of reference with which the selected indicia on dial 210 can be registered when the fasteners 214 are loosened to rotate dial 210 until the selected indicia has been aligned with mark 216. Fasteners 214 are then resecured.

A forward distance pointer 218 is fixed to the upper end of smaller diameter shaft 182 for rotation therewith and in part overlies dial 210 to sweep around dial 210 during travel of the machine up and down the lane. A reverse distance pointer 220 underlies forward distance pointer 218 and is fixed to larger diameter shaft 198 for rotation therewith, the entire reverse distance pointer 210 being received within opening 208 of top plate 206. An upstanding limit stop 222 on the top surface of cover plate 206 limits clockwise rotation of forward distance pointer 218, while another limit stop 224 fixed to the inside edge of opening 208 limits clockwise rotation of reverse distance pointer 220.

Mounted within box 176 are three microswitches 226 (CS1), 228 (CS2) and 230 (CS3). Switch 226 (CS1) is positioned for actuation by forward distance cam 194, switch 228 (CS2) is positioned for actuation by reverse distance cam 200, and switch 230 (CS3) is positioned for actuation by reverse speed switch cam 202. Generally speaking, switch 226 (CS1) determines how far the machine moves down the lane in a forward direction toward the pin deck, switch 228 (CS2) determines how far the machine runs in reverse back toward the foul line, and switch 230 (CS3) determines the speed of the machine in reverse, as well as other functions.

It will be appreciated that while cams 194, 200 and 202 and pointers 218, 220 all rotate together when lane distance wheels 36 rotate, clutch disc 196 permits pointer 218 to be adjusted independently of pointer 220 and, vice-versa, in order to adjust lane distance settings. Furthermore, clutch disc 188 permits overtravel of input worm gear 180 relative to the smaller diameter shaft 182 should that ever be necessary.

As noted earlier, shaft 182 also projects downwardly through and beyond bottom 186 of box 176. Immediately below the bottom 186, shaft 182 has a large diameter cam 232 affixed thereto for controlling restart of dispensing head drive motor 74 during reverse travel of the machine back toward the foul line. A microswitch 234 adjacent reverse dispensing head start-up cam 232 is disposed to be actuated by cam 232 during reverse travel of the machine if the operator has chosen to lay down dressing during the return or reverse travel of the machine as well as the forward travel. Reverse dispensing head start-up cam 232 can be adjustably positioned on shaft 182 in a rotative sense by means not illustrated for varying the reverse distance at which dispensing head 64 recommences its travel back and forth across the lane after having been stopped at the end of the forward pass down the lane. If desired, cam 232 can be so adjusted that switch 234 is never actuated during the return leg of the travel of the machine back toward the foul line so that no dressing is laid down during such return leg.

Relay and Switch Functions

Figure 3:
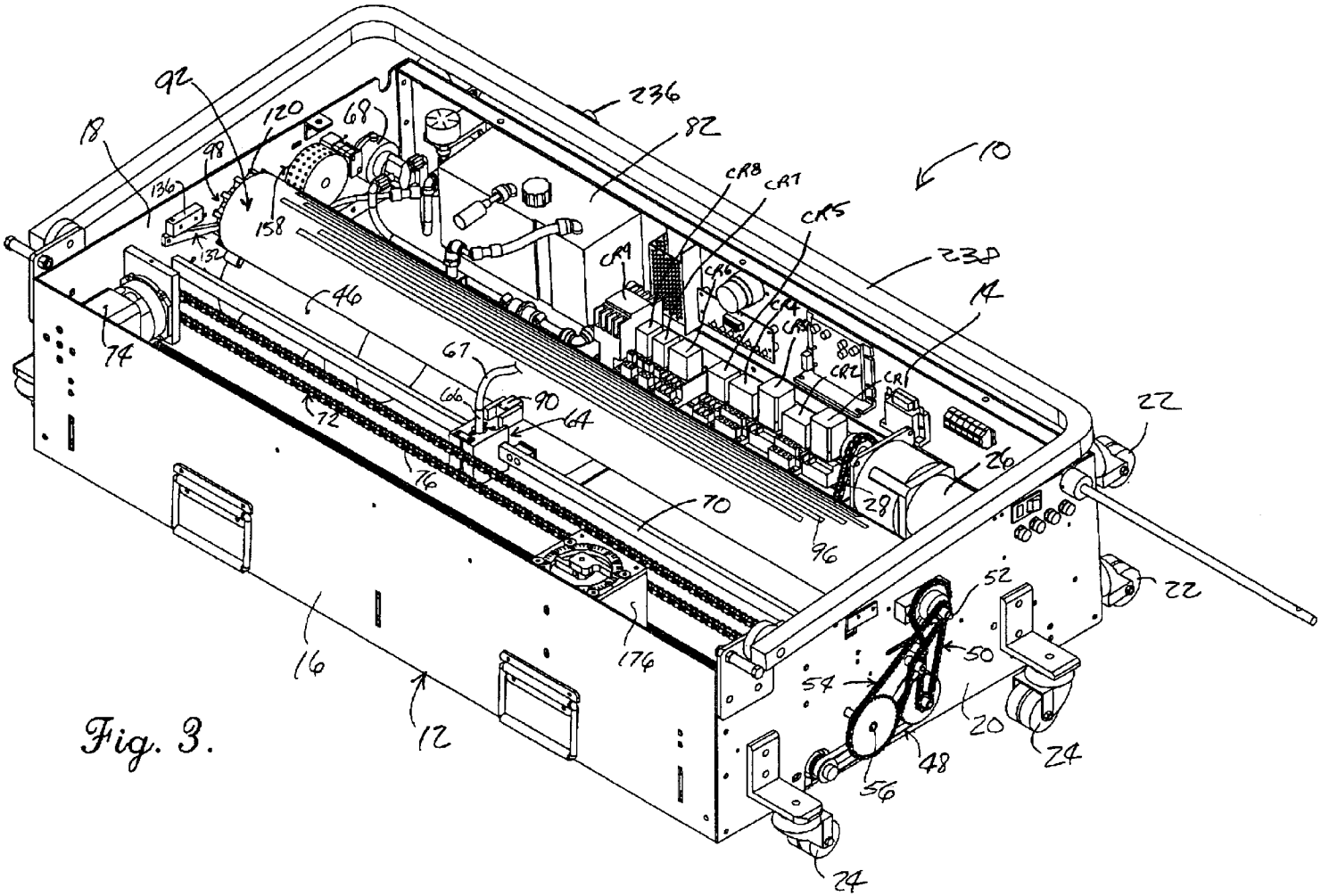
FIG. 3 is a right rear isometric view of the machine.

As shown in FIG. 3, a number of relays CR1 through CR9 are located in the forward part of the housing 12 just inside front wall 14. Such relays perform a variety of functions as will now be described.

CR1 forward latch relay functions as the forward travel memory and maintains status even with power interruptions. It operates the forward travel relay CR2, it is set ON by the normally open contacts of SW2 switch 166. It is reset by CS1 forward travel distance switch 226.

CR2 forward travel relay operates both the buffer motor 46 and the lane drive motor 26 during forward travel. It is turned on by the normally open contacts of CR1 forward latch relay.

CR3 reverse latch relay functions as the reverse travel memory and maintains status even with power interruptions. It operates the reverse travel relay CR4, is set on ON by a time delay relay, and is reset by CS2 reverse distance switch 228.

CR4 reverse drive relay operates both the buffer motor 46 and the lane drive motor 26 during reverse travel. It is turned on by CR3 reverse latch relay.

CR5 interlock holding relay prevents machine functions from starting back up when power is reapplied after a power loss. It is turned on by CR8 start sequence relay and maintains its ON status by its own normally open contacts until power loss.

CR6 dispensing head holding relay operates the dispensing head motor 74 and buffer motor 46 on start up before pattern tube 92 has indexed one increment. It is turned on by CR8 start sequence relay and maintains its ON status by its own normally open contacts until CS2 forward travel relay normally closed contacts become open, which is after the machine has traveled a short distance down the lane, such as 18 inches.

CR7 dressing valve relay operates the dressing control valve 84 and sets CR1 forward latch relay ON to start the forward travel sequence. It is turned on by proximity sensor 90 when a metallic strip 96 is sensed.

CR8 start sequence relay energizes CR5 interlock holding relay and CR6 oil head holding relay to start the machine and to resume machine operation after a power loss. It is turned on by a start button 236 on handle 238 secured to the outside of housing 12.

Buffer motor contactor CR9 conducts AC power to buffer motor 46 when CR2 forward travel relay, CR4 reverse drive relay, or CR6 dispensing head holding relay is energized.

A time delay relay (not shown) provides a 1.0 second delay between forward and reverse travel. It starts when CS1 forward travel switch normally open contacts close. It sets CR3 reverse latch relay ON.

Switches

SW1 switch 164 is used to operate the dispensing head drive motor 74 after the first incremental index of pattern tube 92. It is also used to turn off dispensing head drive motor 74 at the completion of one full cycle up and down the lane and is further used for stopping the dispensing head drive motor 74 at the end of a forward leg of the cycle if the operator chooses to also apply dressing during the return leg toward the foul line.

SW2 switch 166 bypasses SW1 switch 164 during the first two indexes of pattern tube 92 and is used to set ON CR1 forward latch relay after the first index of the pattern tube 92.

SW3 switch 168 is used to control two forward speeds of lane drive motor 26.

CS1 forward distance switch 226 is used to reset CR1 forward latch relay after travel distance has been reached. It is also used to start the time delay relay.

CS2 reverse distance switch 228 is used to enable power to operate CR6 dispensing head holding relay and to complete the circuit to CR1 forward latch relay to prevent both CR1 forward latch relay and CR3 reverse latch relay from latching at the same time and blowing a drive fuse. It is also used to reset CR3 reverse latch relay to stop the machine at the foul line and it can be adjusted to fine tune reverse travel distance.

CS3 reverse speed switch 230 is used for controlling the two speeds of the machine in reverse.

CS4 reverse startup switch 234 is used to restart dispensing head drive motor 74 during return travel of the machine.

Motors

Lane drive motor 26 is operated by CR2 forward travel relay and CR4 reverse drive relay. The buffer motor 46 is operated by CR2 forward travel relay, CR4 reverse drive relay, and CR6 dispensing head holding relay. The dispensing head drive motor 74 is operated by CR6 dispensing head holding relay and SW1 switch 164.

Operation

Generally speaking, machine 10 starts a dressing application cycle at the foul line, moves down the lane in a forward direction toward the pin deck, stops when its full selected travel distance has been achieved, pauses briefly, and then starts a return leg in reverse back toward the foul line where it comes to a stop and awaits transport over to the next lane. As the machine moves along the lane, dispensing head 64 travels back and forth across the lane at a constant rate of speed (except for the changes of direction at opposite ends of its path of travel) as sensor 90 sweeps along the length of pattern tube 92. As sensor 90 detects the beginning of a metallic strip 96, dressing control valve 84 is opened so that dressing at a metered rate is dispensed through nozzle 66 onto the upper transfer roll 58. Transfer roll 58 in turn applies the oil to buffer 38, which engages the lane surface and applies the dressing thereto. When sensor 90 detects the absence of the metallic strip 96, such as mid-length of the pattern tube 92 or at the opposite ends thereof depending upon the pattern selected, valve 84 immediately closes to effectively deactuate head 64 and terminate the dispensing of dressing.

As dispensing head 64 reaches one end of its path of travel, it comes into engagement with the retaining lever 138 at that end of pattern tube 92 and deflects it outwardly toward the proximal sidewall of the housing to release lever 138 from the disc 108 or 120. This allows pattern tube 92 to index one increment until the retaining lever 138 at the opposite end of pattern tube 92 is engaged by the next tooth 128 of the corresponding disc 108 or 120. Thus, as dispensing head 64 then reverses its direction to travel back across the machine in the opposite direction, it moves away from the released retaining lever 138, allowing it to spring back into the next notch 130, but spaced one increment away from the next tooth 128. When the sensor 90 of dispensing head 64 reencounters the beginning of the next metallic strip 96, dressing once again emanates from nozzle 66 in a smoothly flowing stream until the sensed metal strip 96 terminates, whereupon dispensing head 64 is once again deactuated to terminate further dispensing of dressing. As dispensing head 64 continues its movement and comes into engagement with a retaining lever 138, such lever is released, allowing pattern tube 92 to be indexed one more increment.

It is to be noted that when dispensing head 64 is deactuated toward the end of a pass along pattern tube 92, the stream of dressing issuing from nozzle 66 continues to be applied to transfer roll 58 somewhat beyond the end of the sensed metallic strip 96 due to the fact that dispensing head 90 is moving. Thus, the oil pattern will extend somewhat beyond the end of the sensed metallic strip 96, and this should be taken into account when placing strips 96 on pattern tube 92. Correspondingly, even though dispensing head 64 senses the beginning of a metal strip 96 to actuate head 64, the point on the upper transfer roll 58 at which dressing actually first is applied is located somewhat inboard of the start end of the metal strip 96. Thus, the metal strip should start on pattern tube 92 at a point slightly ahead of the point on the upper transfer roll at which the oil pattern is to start. Accordingly, even if the oil pattern is to be the same width from one metal strip 96 to the next strip 96, such strips will be slightly longitudinally offset from one another or staggered as illustrated in the drawings.

The indexing action of pattern tube 92 continues until tube 92 has completed one full revolution. Depending upon the dressing pattern desired, several of the strip locations on pattern tube 92 may be left vacant so that no dressing is laid down at those times. Dressing may or may not be laid down during the return or reverse travel of the machine, depending upon operator preference. The distance traveled by the machine and its speed should be coordinated with the pattern tube 92 such that by the time the machine has returned to the foul line, the pattern tube 92 has been indexed to the 26th strip location, which is an empty location corresponding to the 0, in the cycle. At this point, dispensing head drive motor 74 shuts off and is not restarted until the next cycle on the next lane.

If the operator wishes to select a different dressing pattern, pattern tube 92 is easily removed and exchanged with another pattern tube. This is accomplished by simply removing the retaining screws 106 and 126 at opposite ends of pattern tube 92, manually depressing one of the retaining levers 138, and then lifting tube 92 out of the machine. The outer sleeve assembly 150 is then slipped off core 144 and replaced with a new sleeve assembly, taking care to align notch 152 in the new sleeve assembly with the timing peg 148 on the core 144. The reassembled pattern tube 92 is then simply replaced in the machine by slipping hubs 102 and 122 down over stub shafts 52 and 124 and replacing set screws 106 and 126.

Following is an explanation of the relay and switch sequences experienced by the machine. When power is first applied to the lane machine, switch wheel 158 is at zero, pattern tube 92 is at zero, the lane distance cam box assembly 170 is at zero, and both forward and reverse latch relays CR1 and CR3 are reset. Upon depression of the start button 236, the circuit to the 24 volt DC coil of start sequence relay CR8 is completed. When the contacts of start sequence relay CR8 close, which are normally open (NO), it energizes the coils of the interlock holding relay CR5 and the dressing head holding relay CR6. The interlock holding relay CR5 closes its NO contacts and remains closed until power is interrupted. It is used to enable power to the other relays and components, and acts as an interlock. The NO contacts of the dispensing head holding relay CR6 close, and remain closed, until switch wheel 158 indexes one notch. The buffer motor contactor CR9 and dispensing head drive motor 74 are operating through the NO contacts of the dressing head holding relay CR6 at this time.

As dispensing head 64 moves toward the 10-pin side (right side), it will impact retaining lever 168 of retainer 134 and allow pattern tube 92 and switch wheel 158 to index one increment. When switch 158 indexes the first increment, SW1 microswitch 164 will return to the NO position, which will turn off the dispensing head holding relay CR6. Also, SW2 microswitch 166 with NO contacts will close and set the forward latch relay CR1 on. From this point on, SW1 microswitch 164 uses the NC contacts to operate dispensing head drive motor 74 until switch wheel 158 makes a full indexing cycle, at which time the NC contacts of SW1 microswitch 164 open to stop dispensing head drive motor 74. In the event dressing is to be applied during the return leg, an appropriate set screw 162 will have been inserted in a threaded hole 160 of the first row of holes 160 on switch wheel 158. In addition, screws 162 will have been inserted at appropriate locations in the second row of holes 160 on switch wheel 158. This will cause the dispensing head drive motor 74 to stop temporarily and to then start up again depending upon the position of reverse dispensing head startup cam 232 as it actuates CS4 reverse startup switch 234.

When the forward latch relay CR1 is set ON, it operates forward relay CR2 which operates lane drive motor 26 and buffer motor 46. As the machine moves down the lane, buffer motor 46 rotates buffer 38 and also operates dressing pump 68, transfer rollers 58, 62, and pattern tube slip clutch 100 through the various chain and sprocket assemblies and cog belt assemblies. Dispensing head 64 moves back and forth to index pattern tube 92 and switch wheel 158. When dispensing head 64 passes the metallic strips 96 on pattern tube 92, it energizes dispensing valve relay CR7 and closes the NO contacts, which turns on valve 84.

Drive speed changes occur when switch wheel 158 operates SW3 microswitch 168. There are two possible speeds when traveling forward.

As the machine travels down the lane, cam box assembly 170 operates from the linear motion of the machine to control the overall travel distance. When the machine has traveled one foot in the forward direction, the CS2 reverse reset 228 switch disables the ability of the start sequence relay CR8 to energize dispensing head holding relay CR6. This prevents pattern tube 92 from starting again, if it has finished indexing, when the machine has interlocked and then resumed by pressing start button 236.

When the machine has reached its desired distance set by cam box assembly 170, CS1 forward distance switch 226 within cam box assembly 170 will reset forward latch relay CR1. When the forward latch relay CR1 is reset, it sends power to the time delay module, which sets the reverse latch relay CR3. The reverse latch relay CR3 operates the reverse relay CR4, which operates buffer motor 46 and lane drive motor 26. CS3 reverse speed switch 230 within cam box assembly 170 now controls the speed of the machine. Preferably, there are two reverse speeds.

As the machine continues to travel in reverse, the reverse oil start cam 232 actuates CS4 reverse startup switch 234 to restart dispensing head drive motor 74. The machine continues to operate in reverse and shifts to a lower speed determined by CS3 reverse speed switch 230 in cam box assembly 170. When the machine reaches the foul line, cam box assembly 170 will return to zero, reset the reverse latch relay CR3, and stop the machine. The machine is now ready to operate on the next lane.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What is claimed is:

1. In a machine that is operable to travel along a bowling lane and to apply dressing to the surface of the lane during such travel, the improvement comprising:

a dressing dispensing head movable back and forth along a transverse path of travel across the lane as the machine travels along the lane, said head being operable when in an actuated condition to dispense dressing to an applicator of the machine during movement of the head along said transverse path of travel and when in a deactuated condition to refrain from dispensing dressing to the applicator during movement along said transverse path of travel;

a sensor movable with said dispensing head;

a control device having a certain control pattern of sensor-detectable structure thereon corresponding to a certain pattern of dressing for the lane, said sensor being operable to sense a portion of the control pattern during movement of the head along said transverse path of travel for actuating and deactuating the dispensing head at predetermined locations along the transverse path of travel; and indexing mechanism for periodically indexing said control device to present new portions of the control pattern to the sensor.

2. In a machine as claimed in claim 1, said mechanism being responsive to movement of the head along said transverse path of travel.

3. In a machine as claimed in claim 2, said control device including an elongated member extending alongside said transverse path of travel of the dispensing head and having said control pattern thereon, said member being rotatable about its longitudinal axis during said indexing of the control device.

4. In a machine as claimed in claim 3, said indexing mechanism including a constantly rotating drive for said member, a releasable retainer operable to releasably retain the member against indexing rotation with said drive, and a slip clutch between the drive and the member operable to allow the drive to rotate without indexing the member while the member is retained by said retainer and to rotate the member when the retainer is released, said dispensing head being operable to momentarily release said retainer when the dispensing head reaches an end of its transverse path of travel to permit the drive to index the member.

5. In a machine as claimed in claim 3, said member having a plurality of longitudinally extending, circumferentially spaced metallic strips that present the control pattern, said sensor being responsive to the presence and absence of said strips.

6. In a machine as claimed in claim 3, further comprising a mobile frame, said member being removably mounted on said frame to permit members with different control patterns to be selectively interchangeably installed in the machine.

7. In a machine as claimed in claim 1, said control device having a plurality of longitudinally extending, laterally spaced metallic strips that present the control pattern, said sensor being responsive to the presence and absence of said strips.

8. In a machine as claimed in claim 1, further comprising a mobile frame, said control structure being removably mounted on said frame to permit control structures with different control patterns to be selectively interchangeably installed in the machine.

* * * * *